US008201307B2

(12) United States Patent
Romero

(10) Patent No.: US 8,201,307 B2
(45) Date of Patent: Jun. 19, 2012

(54) DOOR HANDLE RETAINER SYSTEM

(75) Inventor: Oscar Romero, Lake Forest, CA (US)

(73) Assignee: Newfrey LLC, Newark, DE (US)

( * ) Notice: Subject to any disclaimer, the term of this patent is extended or adjusted under 35 U.S.C. 154(b) by 1297 days.

(21) Appl. No.: 11/008,420

(22) Filed: Dec. 9, 2004

(65) Prior Publication Data

US 2006/0123599 A1 Jun. 15, 2006

(51) Int. Cl.
*E05B 1/00* (2006.01)

(52) U.S. Cl. ..... 16/412; 16/DIG. 24

(58) Field of Classification Search ..... 16/412–414, 16/422, 110 R, DIG. 24, DIG. 25, DIG. 29, 16/DIG. 32, DIG. 41; 292/341.18, 336.3, 292/336.5, 347, 348, 350; 70/207, 224, 221
See application file for complete search history.

(56) References Cited

U.S. PATENT DOCUMENTS

| | | | | |
|---|---|---|---|---|
| 201,906 | A * | 4/1878 | Brady | 292/351 |
| 818,565 | A * | 4/1906 | Schwarz | 292/350 |
| 1,103,963 | A * | 7/1914 | Harlow et al. | 292/350 |
| 2,644,704 | A * | 7/1953 | Hagstrom | 292/169.18 |
| 2,699,353 | A * | 1/1955 | Nagy et. al. | 292/336.3 |
| 2,805,094 | A * | 9/1957 | Stoakes | 292/336.3 |
| 2,885,880 | A * | 5/1959 | Muttart | 70/476 |
| 4,732,418 | A | 3/1988 | Crown et al. | |
| 4,838,053 | A | 6/1989 | Shen | |
| 4,912,809 | A * | 4/1990 | Scheuer | 16/413 |
| 5,657,653 | A | 8/1997 | Hensley et al. | |
| 6,463,628 | B1 * | 10/2002 | Yeh | 16/412 |
| 6,840,070 | B1 * | 1/2005 | Huang et al. | 70/134 |
| 2004/0123427 | A1 * | 7/2004 | Lee | 16/412 |
| 2005/0060844 | A1 * | 3/2005 | Chiang | 16/412 |

FOREIGN PATENT DOCUMENTS

WO WO 2004/03596 A2 4/2004

* cited by examiner

*Primary Examiner* — Victor Batson
(74) *Attorney, Agent, or Firm* — Carlson, Gaskey & Olds, P.C.

(57) ABSTRACT

A door handle assembly providing an entry function includes a sleeve, a spindle and a handle that fits over the sleeve. Gap and play between the handle and the sleeve is eliminated by tightening of a threaded fastener against an inner surface of the handle. A tool is selectively received through an opening in the spindle for tightening the threaded fastener. The opening in the spindle is alignable with an aperture in the handle when in an unlocked condition. The tool is then permitted to extend through the aperture and the opening in the spindle to engage the threaded fastener. A second end of the threaded fastener abuts the inner surface of the handle, securing the handle to the sleeve. Another door handle assembly according to this invention provides a privacy function and includes a threaded fastener that contacts an inner surface of a door handle assembly.

20 Claims, 5 Drawing Sheets

DOOR HANDLE RETAINER SYSTEM

BACKGROUND OF THE INVENTION

The present invention relates to a removable door handle, and more particularly to a secure attachment of a removable door handle to a sleeve that drives the mechanism to open the door.

Door handles, such as levers and knobs, are typically removably mounted to a lock mechanism contained within the door to meet assembly and manufacturing requirements. One current method for mounting a door handle is with a lever catch. Although effective, the lever catch may provide a somewhat sloppy feeling between the door handle and lock mechanism.

Another method of securing a handle to a lock mechanism includes the use of a setscrew. Disadvantageously, locating the setscrew on the lever may provide assembly and manufacturing difficulties. Such difficulties include cutting the threads on a handle that has already been finished or cutting the threads on the handle then finishing the handles such that the finishing may block the threaded opening. Another difficulty is that the setscrews, when mounted through the lever, can be fully backed out during installation and become lost.

Mounting the setscrew through the outer diameter of the handle presents a security concern because the setscrew is accessible on an exterior keyed handle, an unauthorized person can completely remove the setscrew from the exterior, remove the handle, disable the lock mechanism, and gain access through the door.

Accordingly, it is desirable to provide a secure removable door handle which may be used on interior and exterior doors, which minimizes play between the door handle and lock mechanism.

SUMMARY OF THE INVENTION

The door handle assembly according to the present invention includes a sleeve a spindle, and a handle housing. The handle housing fits over the sleeve. A gap between the sleeve and the handle housing permits the door handle assembly to be readily assembled. A setscrew within the sleeve is then rotated to secure the handle and eliminate "play" between the sleeve and the handle.

A door handle assembly providing an entry function includes threaded fastener is threaded outwardly from the sleeve and into the handle housing to eliminate the gap once the handle housing is mounted. A tool is received through an opening in the handle housing and through an opening in the spindle. The spindle opening is selectively alignable with the opening in the handle housing to allow the tool to extend through the spindle and to the fastener. Alignment of the opening in the spindle and the handle housing is only possible when in an unlocked condition. The openings in the spindle and the handle housing are not alignable when the door is in a locked condition, and therefore the tool cannot engage the fastener. The fastener extends from the sleeve into a cavity in the lever handle. Tightening the fastener against the lever housing secures the lever housing and minimizes play.

Another door handle assembly providing a privacy function includes a threaded member that is threaded outwardly from the sleeve to engage an inner surface of the door handle. A tool extends through an opening in the door handle and engages the threaded member. The tool is always permitted to engage the threaded member for the door handle assembly providing the privacy function. Accordingly, the threaded member engages an inner surface of the door handle to secure the handle and minimize "play". The handle assembly of this invention is adaptable for use on both left and right handed doors thereby eliminating the need for specialized handle assemblies.

The present invention therefore provides a secure removable door handle which may be used on interior and exterior doors to retain the handle securely and to minimize play between the door handle and lock mechanism.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
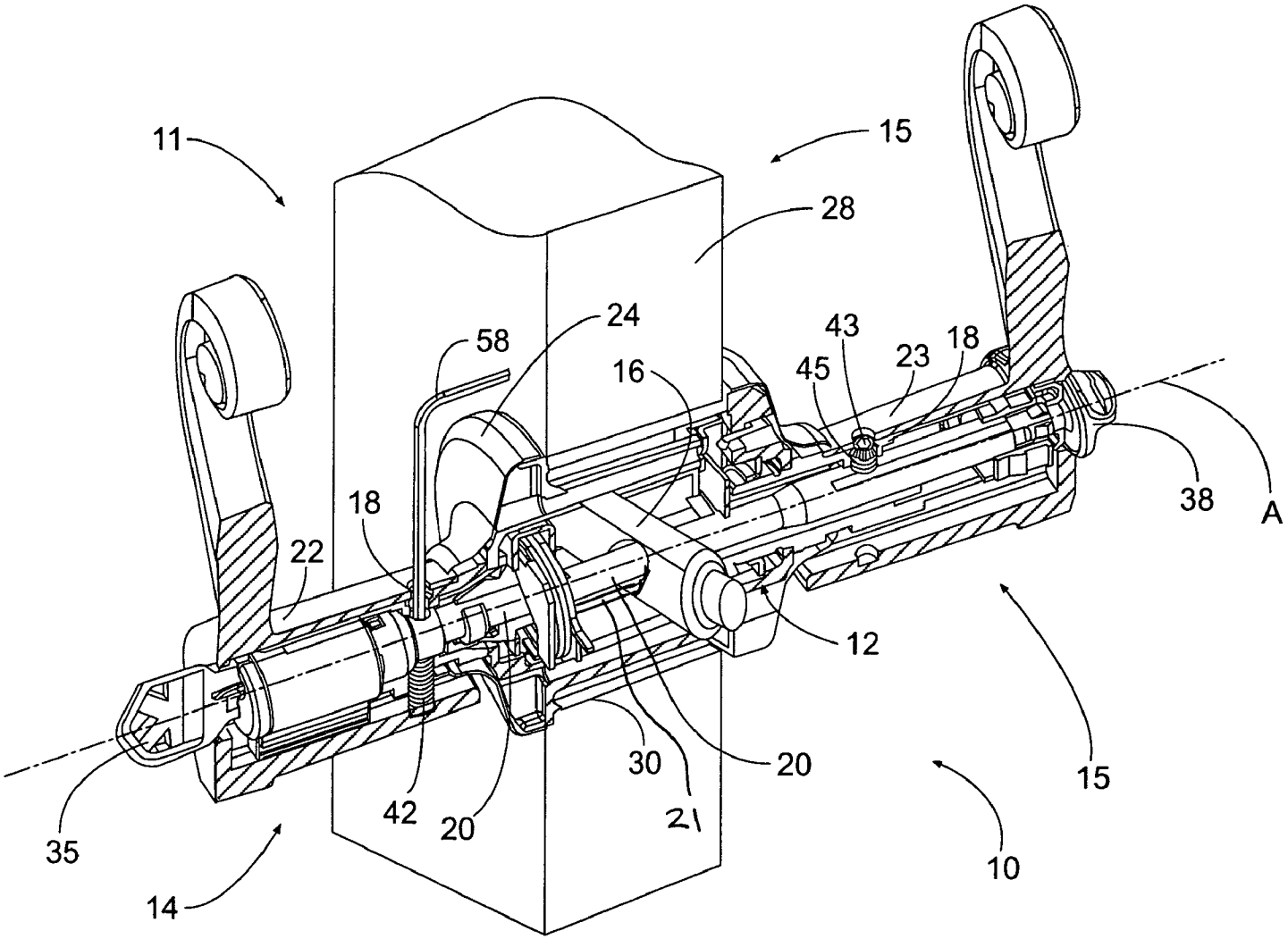
FIG. 1 is a perspective view of a door handle assembly of the present invention.

FIG. 1 illustrates a door handle assembly 10 that rotates about a handle axis A. The door handle assembly 10 illustrated is for an entry door for an exterior door that is unlockable with a key 35. The entry door includes the exterior side 11 unlockable with the key 35 and an interior side 15 unlockable with a turn button 38. The handle assembly 10 includes an interior chassis 12, an exterior chassis 14, and a latch assembly 16. It should be understood that although a lever component arrangement is disclosed in the example embodiment other handle arrangements such as knobs would also benefit from the instant invention. The interior chassis 12 includes a sleeve 18 and a spindle 20. The exterior chassis 14 includes a lever housing 22 and a rose liner 24 on each side of the door 28. The rose liner 24 covers a door opening 30 that extends through the door 28. A fastener 42 is mounted within the sleeve 18 for securing the lever housing 22 and to minimize play between the sleeve 18 and the lever housing 22.

The interior side 15 includes a threaded fastener 43 threaded into a threaded opening 45 of the sleeve 18. The fastener 43 is threaded outward from the sleeve 18 to contact an inner surface 17 of an interior handle 23. Tightening the fastener 43 secures the interior handle 23 to substantially eliminate play between the sleeve 18 and the handle 23. The exterior handle 22 and interior handle 23 are of a common configuration providing for interchangeability of door handles. This interchangeability provides for the use of a common set of handles for a left and a right handed door, thereby eliminating the need for different handle assemblies corresponding to the side on which the door opening is disposed.

Figure 2:
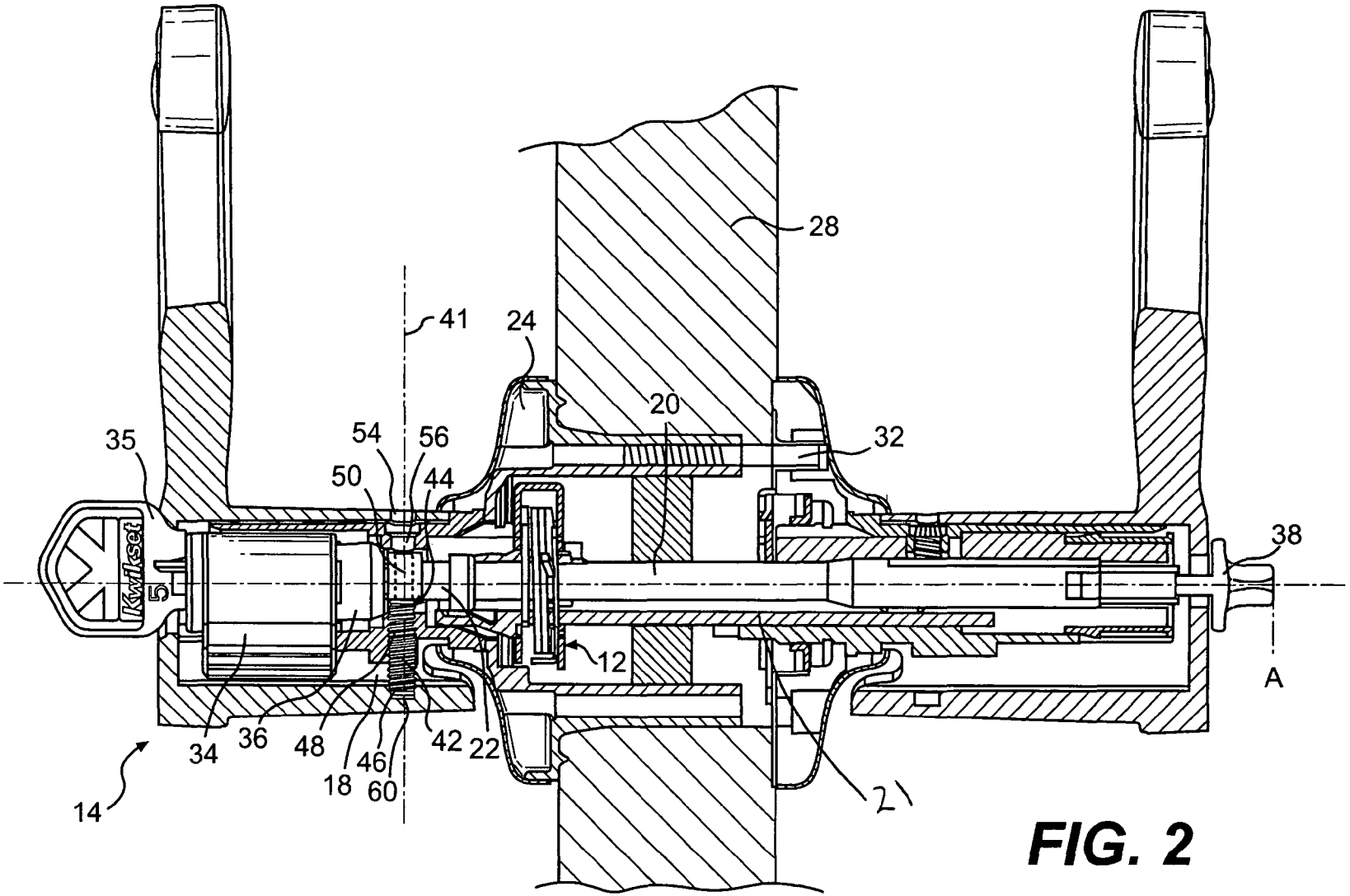
FIG. 2 is a cross-sectional view of the door handle assembly according to the present invention.

Referring to FIG. 2, the exterior chassis 14 and interior chassis 12 are secured within the opening 30 of the door by threaded fasteners 32. The handle assembly 10 includes a lock assembly 34 actuatable between a locked and unlocked condition. The turn button 38 is provided to move the lock assembly 34 between the locked and unlocked conditions.

Further, the lock assembly 34 includes a cylinder 36 actuatable by the key 35 for unlocking the lock assembly 34. Unlocking of the lock assembly 34, either by the key 35 or the turn button 38 permits rotation of the lever housing 22.

Once unlocked, rotation of the sleeve 18 by the lever housing 22 rotates the spindle 20 that in turn actuates a latch assembly 16 (FIG. 1) to open the door 28. Once the turn button 38 and/or a valid key unlocks the lock assembly 34, the lever housing 22 is rotated to rotate the sleeve 18 and a half round spindle 21 to actuate the latch assembly 16 in a conventional manner.

The fastener 42 is preferably a threaded setscrew with a first end 44 adapted for receiving a tool 58 (FIG. 4) and a second end 46 that abuts a blind hole 60 within the lever housing 22. The fastener 42 is threaded into a threaded aperture 48 formed in the sleeve 18. The threaded aperture 48 is disposed along a fastener axis 41 transverse to the axis A. The sleeve 18 includes an opening 56 disposed along the fastener axis 41 on an opposite side of the threaded aperture 48. Between the opening 56 and the threaded aperture 48 is the spindle 20. The spindle 20 includes an opening 50. The spindle opening 50 is selectively alignable with the fastener axis 41 and thereby with the opening 56 and the threaded aperture 48. The spindle 20 is rotatable into alignment with the fastener axis 41 when the lock assembly 34 is in the unlocked or a neutral condition. The neutral condition comprises a position where the handle is disposed somewhere between the unlocked and locked position. The lever housing 22 includes an opening 54 that aligns with the opening 56 along the fastener axis 41.

Figure 3:
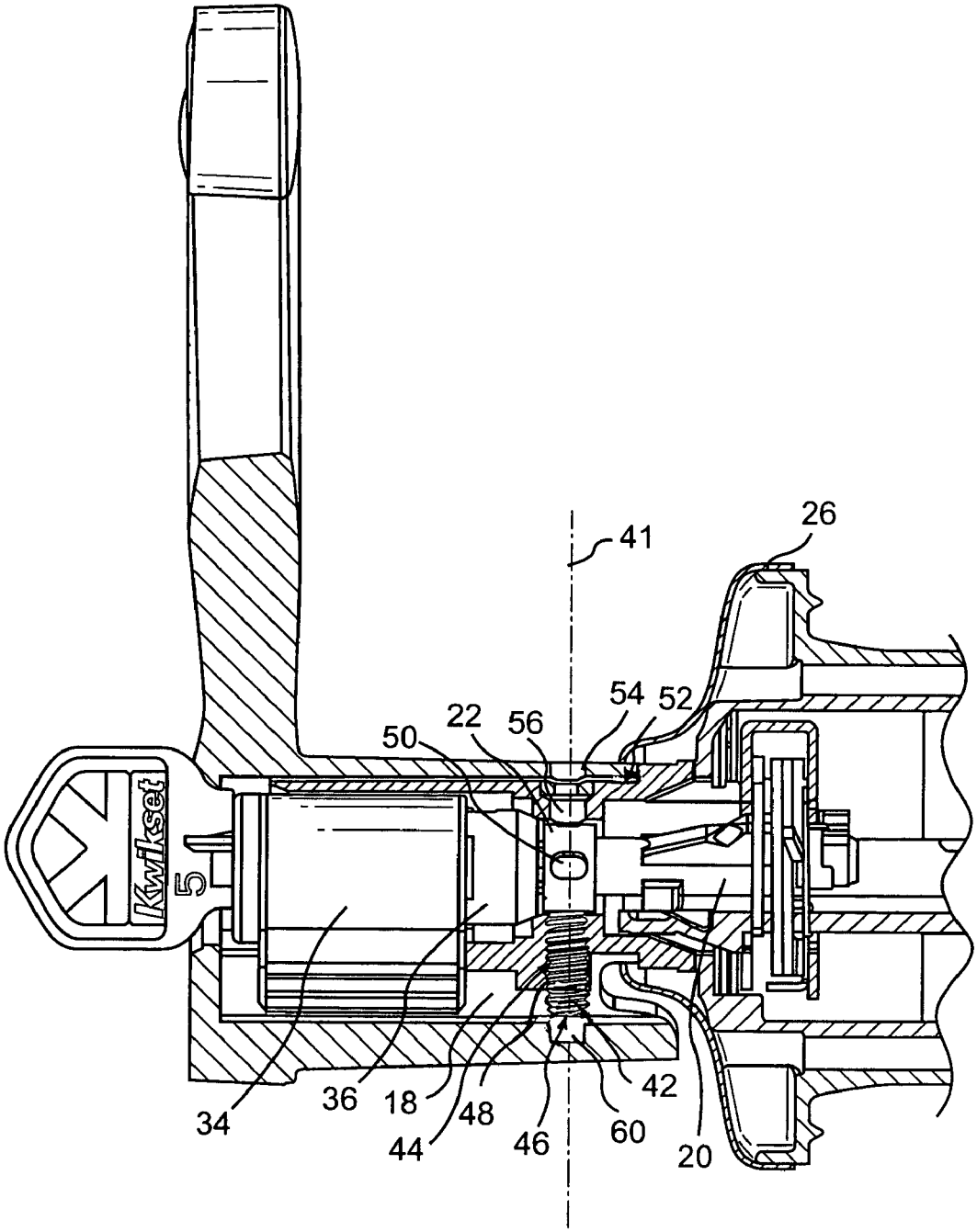
FIG. 3 is a partial sectional view of an exterior door handle for an entry door handle assembly with a fastener in a first position.

Referring to FIG. 2, the fastener 42 is rotated to extend into the blind hole 60 within the lever housing 22. The opening 54 is preferably sized to receive the tool 58. FIG. 3 illustrates the fastener 42 in a position providing for installation of the lever housing 22. The second end 46 of the fastener 42 is substantially flush with an outer diameter 52 of sleeve 18. The lever housing 22 slides over the sleeve 18 and generally against the rose liner 24. The space between the outer diameter 52 and the inner surface of the lever housing 22 provides play desired to provide installation of the lever housing 22 to the sleeve 18. The opening 50 in the spindle 20 is not aligned along the fastener axis 41 and blocks entry of the tool 58 (FIG. 4) and engagement with the fastener 42.

Figure 4:
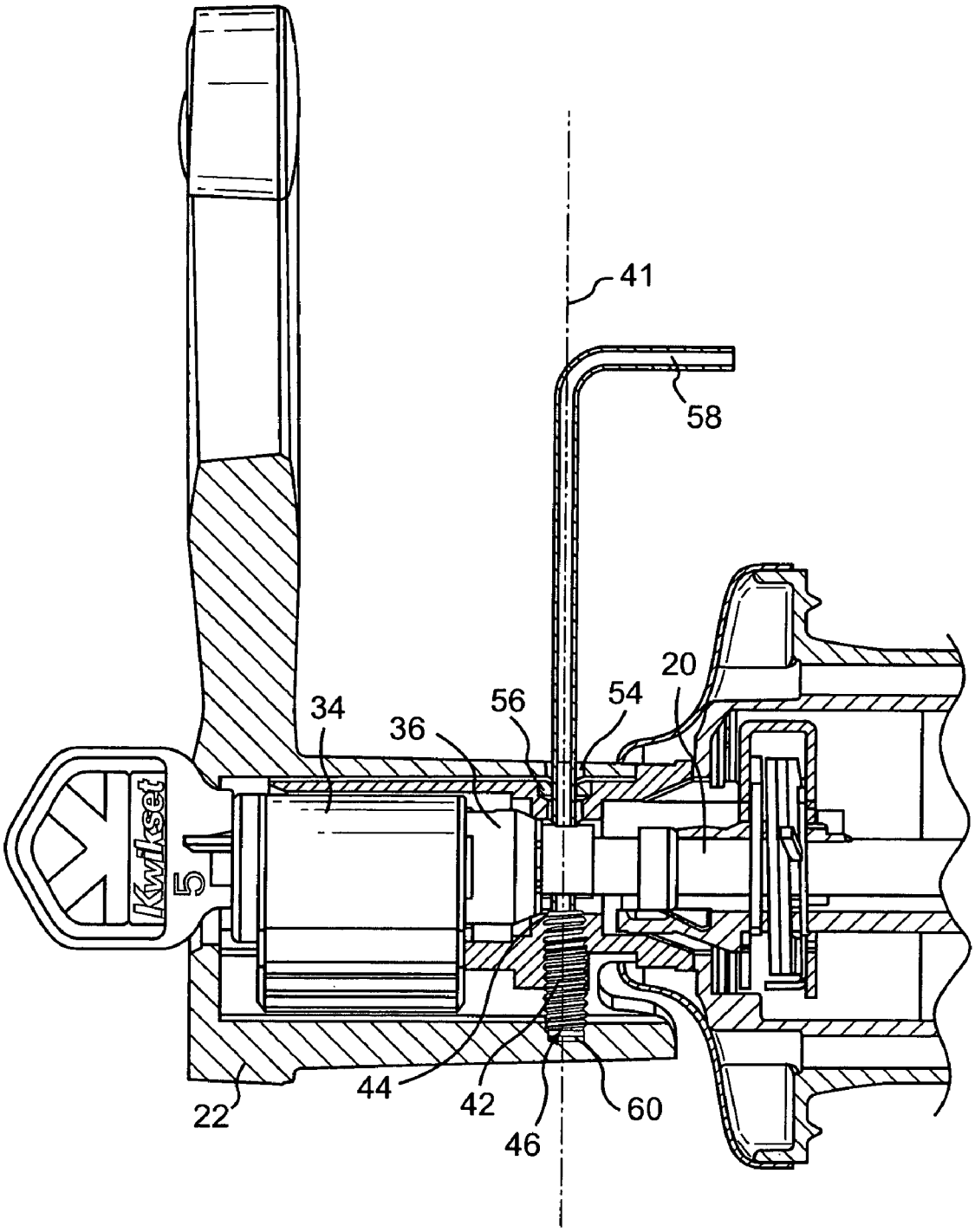
FIG. 4 is a partial sectional view of door handle assembly with the fastener in a second position.

Referring to FIG. 4, the play between the lever housing 22 and the sleeve 18 is accommodated by threading the fastener 42 radially outward from the sleeve 18 and into the blind hole 60 of the lever housing 22. The second end 46 of the threaded fastener 42 abuts the lever housing 22 within the blind hole 60 and provides a substantially rigid interface that substantially removes play between the lever housing 22 and the sleeve 18.

The tool 58 utilized to thread the fastener 42 outward is receivable through the spindle 20 to engage the first end 44 of the fastener only when the lock assembly 34 is in the unlocked condition. When the lock assembly 34 is in a locked condition, the opening 50 is not alignable along the fastener axis 41. This condition is illustrated in FIG. 3, where the opening 50 is shown in a position substantially transverse to the fastener axis 41. With the lock assembly 34 in the unlocked condition, the opening 50 is alignable, providing for the feeding of the tool 58 into the handle assembly 10 and into engagement with the fastener 42. The tool 58 is inserted through the opening 54 in the lever housing 22 and the opening 56 in the sleeve 18. The tool 58 can be inserted through the openings 54 and 56 at any time, however, without the opening 50 in proper alignment, the tool is prevented from engaging the fastener 42. Accordingly, removal of the lever housing 22 by removal of the fastener 42 is not permitted. With the spindle 20 moved to a position that aligns the opening 50 along the fastener axis 41, the tool is permitted to extend through the spindle 20 and into engagement with the fastener 42. The threaded fastener 42 may then be threaded outwardly against the lever housing 22. Further, the lever housing 22 may be threaded radially inward to retract the fastener 42 into the sleeve 18 to permit removal of the lever housing 22.

Accordingly, the tool 58 is selectively blocked from engaging the threaded fastener 42 to prevent undesired removal of the lever housing 22. Selectively unscrewing the fastener 42 from the sleeve 18 and wedging the second end 46 into the blind hole 60 minimizes clearance between the sleeve 18 and the lever housing 22. The lever housing 22 is effectively driven transverse to the sleeve 18 such that a solid feeling is provided between the sleeve 18 and the lever housing 22. Moreover, the reduction in "play" substantially eliminates droopiness and any sloppy feeling commonly experienced in conventional door handles, while preventing unauthorized removal.

Figure 5:
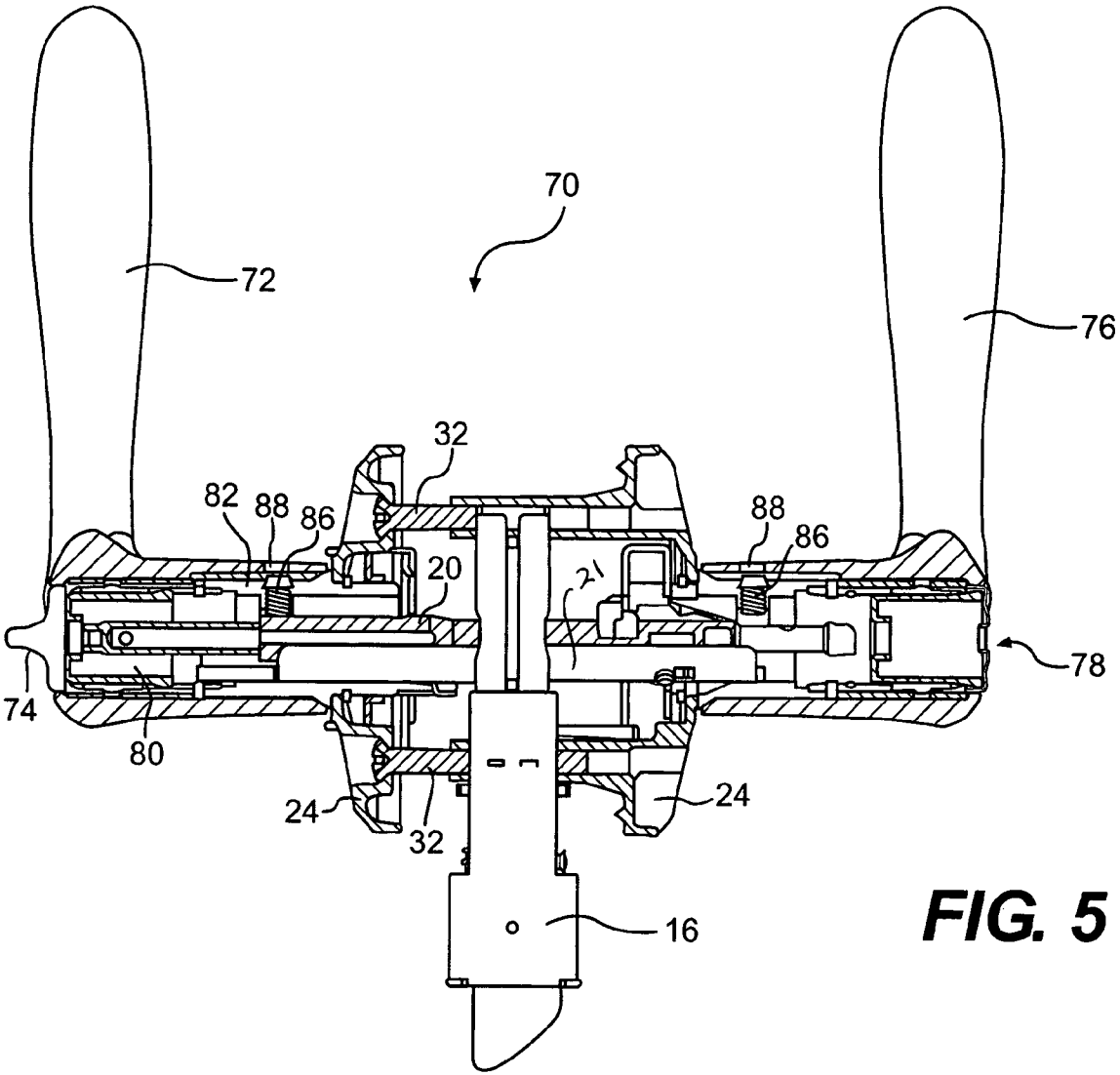
FIG. 5 is a cross-sectional view of an embodiment of this invention utilized for a privacy door handle assembly.

Referring to FIG. 5, another lock assembly 70 according to this invention is shown for an interior door and includes an interior handle 72 with a turn button 74, and an exterior handle 76. The exterior handle includes an opening 78 for a tool (not shown). A tool, such as a screwdriver received within the opening 78 may be used to unlock a lock 80. The lock assembly 70 includes a sleeve 82 and a spindle 84 that extends through the door to each of the handles 72, 76. The handles 72, 76 are assembled over the sleeve 82 and secured in place by setscrews 86. The setscrews 86 are received within threaded openings 88 within the sleeve 82.

The setscrews 86 are initially installed in a position that is substantially flush with an exterior surface of the sleeve 82 such that each of the handles 72,76 maybe assembled to the sleeve 82. A tool such as an Allen wrench shown in FIG. 4 is then inserted through an opening 88 within each of the handles 72,76 to engage the setscrew 86. Turning the setscrew 86 outwardly causes engagement to tighten against and secure each of the handles 72, 76. The opening 88 is of a smaller size than the setscrew 86 such that the setscrew 86 engages an inner surface of each of the handles 72,76. This provides for a secure and wobble free attachment of the handles 72,76 for an interior door.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A handle assembly comprising:

a handle housing that defines a first axis;

a sleeve mountable to a door along the first axis; and a threaded fastener received within said sleeve, said threaded fastener including a first end adapted for receiving a tool, and a second end distal from said first end engageable with an internal surface of said handle housing when a tool is received in the first end.

2. The assembly as recited in claim 1, including a spindle rotatable relative to said handle housing and including a spindle opening alignable with said threaded fastener.

3. The assembly as recited in claim 2, including a handle opening within said handle housing selectively alignable with said spindle opening.

4. The assembly as recited in claim 3, wherein said sleeve includes an opening aligned with said handle opening.

5. The assembly as recited in claim 3, wherein said threaded fastener is disposed within said sleeve on a side opposite said handle opening.

6. The assembly as recited in claim 5, wherein the tool is received through said handle opening and said spindle opening to engage said threaded fastener.

7. The assembly as recited in claim 5, including a lock assembly having a locked condition and an unlocked condition, wherein said spindle opening is alignable with said handle opening when said lock assembly is not in said locked condition.

8. The assembly as recited in claim 5, wherein said handle housing includes a blind hole on said internal surface disposed opposite said handle opening and a portion of said second end of said threaded fastener is movable into said blind hole for securing said handle housing to said sleeve.

9. The assembly as recited in claim 1, wherein said threaded fastener is received within a threaded opening defined by said sleeve.

10. A handle assembly comprising:

a handle housing that defines a first axis, said handle housing comprising an aperture and a blind hole defining a fastener axis transverse to said first axis;

a sleeve defining a threaded aperture along said fastener axis; and a threaded fastener threaded into said threaded aperture and including a first end for receiving a tool for turning said threaded fastener and engaging said blind hole of said handle housing.

11. The handle assembly as recited in claim 10, wherein said threaded fastener includes a second end distal from said first end engageable with said handle housing.

12. The handle assembly as recited in claim 11, further comprising a spindle, said spindle disposed between said aperture and said threaded fastener, said spindle including a spindle opening selectively alignable with said fastener axis.

13. The handle assembly as recited in claim 12, including a lock assembly settable in a locked condition and an unlocked condition, wherein in said unlocked condition said spindle opening is alignable along said fastener axis providing for a tool to extend through said aperture and said spindle opening to engage said first end of said threaded fastener.

14. The handle assembly as recited in claim 13, wherein said spindle opening is not alignable with said fastener axis with said lock assembly in said locked condition.

15. The handle assembly as recited in claim 10, wherein said sleeve includes an opening aligned with said aperture for receiving the tool.

16. The handle assembly as recited in claim 10 wherein said first end of said threaded fastener is threaded radially outward into engagement with said handle housing.

17. A method of assembling a handle assembly comprising the steps of:

(1) fitting a handle housing over a sleeve along a first axis;

(2) aligning an aperture within said handle housing with an opening within a spindle, the spindle disposed between said handle housing and the sleeve; and (3) rotating a fastener at least partially out of the sleeve along a second axis transverse to the first axis to engage a blind hole within an inner periphery of the handle housing.

18. A method as recited in claim 17, wherein said step (2) includes selecting an unlocked condition for a lock assembly such that the opening within the spindle is alignable with the aperture within said handle housing.

19. A method as recited in claim 17, wherein said step (3) includes inserting a tool through the aperture in the handle housing and the opening in the spindle and engaging a first end of the fastener.

20. A method as recited in claim 17, including the step of blocking insertion of a tool through the opening in the spindle responsive to a lock assembly being in a locked condition.

* * * * *